US006935506B1

(12) United States Patent
Boyle et al.

(10) Patent No.: US 6,935,506 B1
(45) Date of Patent: Aug. 30, 2005

(54) PHOTOGRAPH HOLDER

(75) Inventors: Daniel J. Boyle, Hartland, WI (US); David L. Stuhr, Libertyville, IL (US)

(73) Assignee: Rock-Tenn Company, Norcross, GA (US)

( * ) Notice: Subject to any disclaimer, the term of this patent is extended or adjusted under 35 U.S.C. 154(b) by 147 days.

(21) Appl. No.: 10/177,702

(22) Filed: Jun. 21, 2002

(51) Int. Cl.[7] ..... B65D 69/00
(52) U.S. Cl. ..... 206/578; 206/225; 206/455
(58) Field of Search ..... 206/223, 214, 206/455, 456, 578, 389, 225, 486, 487, 475, 206/478; 40/701, 775, 776

(56) References Cited

U.S. PATENT DOCUMENTS

| | | | | | |
|---|---|---|---|---|---|
| 1,896,678 | A | * | 2/1933 | Myers | 206/476 |
| 3,232,513 | A | * | 2/1966 | Maio | 206/455 |
| 3,847,282 | A | * | 11/1974 | Collura et al. | 206/782 |
| 4,171,050 | A | * | 10/1979 | Murray et al. | 206/463 |
| 4,570,787 | A | * | 2/1986 | Forbes, Jr. | 206/780 |
| 5,029,709 | A | | 7/1991 | Faulstick | |
| 5,255,865 | A | * | 10/1993 | Buell et al. | 242/613 |
| D342,205 | S | * | 12/1993 | Ritz | D9/432 |
| 5,678,754 | A | | 10/1997 | Kranz | |
| 5,704,472 | A | | 1/1998 | Werner et al. | |
| 5,709,496 | A | | 1/1998 | Werner et al. | |
| 5,788,074 | A | | 8/1998 | Tanabe et al. | |
| 5,803,259 | A | | 9/1998 | Riedel | |
| 5,816,392 | A | | 10/1998 | Kawagoe et al. | |
| 5,823,330 | A | | 10/1998 | Werner et al. | |
| 5,833,059 | A | | 11/1998 | Werner et al. | |
| 5,836,449 | A | | 11/1998 | Peeters | |
| 5,938,031 | A | | 8/1999 | Woods | |
| D416,584 | S | * | 11/1999 | Ho | D19/78 |
| 5,984,167 | A | | 11/1999 | Roccaforte | |
| 6,045,034 | A | | 4/2000 | Roccaforte et al. | |
| 6,106,014 | A | | 8/2000 | Werner et al. | |
| 2002/0060168 | A1 | | 5/2002 | Smith | |

* cited by examiner

*Primary Examiner*—Shian T. Luong
(74) *Attorney, Agent, or Firm*—Kilpatrick Stockton LLP

(57) ABSTRACT

The invention relates to a photograph holder formed from a single blank and used to contain multiple photographs and a generally cylindrical film cartridge, such as an APS film cartridge. The photograph holder includes a photograph compartment for containing a plurality of photographs and film cartridge compartment formed from a panel created by cutting portions of the blank on at least one side edge of the holder and pushing the cut portions inward toward the interior of the holder. Unlike other photograph holders, the film cartridge is visible from the exterior of the photo holder so that consumers can view the unique APS identification number when the photo holder is closed. The photo holder is particularly useful in ensuring that the film cartridge is not separated from the corresponding photographs.

23 Claims, 7 Drawing Sheets

PHOTOGRAPH HOLDER

The invention relates to a photograph holder for holding multiple photographs and a film cartridge. The invention is particularly well suited for use with Advanced Photo System (APS) photographs and film cartridges.

BACKGROUND

Folders for holding photographic prints generally include a single pocket. They sometimes include a divider or second pocket so that negatives may be placed in the folder with the photographs. These folders are generally constructed from thin, insubstantial paperboard that is susceptible to tearing and does not provide protection for the photographic prints and negatives, which may be easily damaged.

The development of the Advanced Photo System (APS) presents additional problems for packaging developed photographs with the corresponding negatives. APS film is contained in a cartridge similar to that of 35 mm film. Like 35 mm film, when APS film is processed, it is removed from the cartridge. However, after processing, APS negatives are placed back in the original cartridge rather than provided to the customer in flat strips as in conventional 35 mm film.

Currently, when APS film is developed, the APS cartridge is simply placed in an envelope with the photographs, much like a traditional negative would be. Because the APS film cartridge is not thin and flat like a traditional negative, an envelope may not provide sufficient protection to the APS film cartridge. Often, additional protection, such as a box or an inner envelope is provided for the photographs, but generally, no provision is made for the APS film cartridge. Although an APS film cartridge provides added security for negatives, it is not damage proof. Improper handling can result in breaking the cartridge and damaging the negative. The cartridge may also fall out of existing photo holders. Thus, a envelope, box or other photograph holder that provides protection for an APS film cartridge is needed.

It is also important that the APS film cartridge not be separated from the photographs. Because APS negatives are stored within a cartridge, they cannot be easily viewed, as traditional negatives can. Separating the APS negatives from the photographs can cause substantial problems for the consumer, as it may be difficult to identify the corresponding negatives when reprints or enlargements are desired. When traditional photo holders, which do not provide a compartment for the APS film cartridge, are used, it is more likely that the film cartridge will be separated from the photos. Even photo holders providing a compartment for the APS film cartridge are likely to allow the film cartridge to fall out of the photo holder because most do not have a locking mechanism.

Although consumers generally care most about the photographs, at least initially, the negatives are of utmost importance in truly preserving the images and memories captured in the photographs. By preserving the negatives, the consumer is able to have additional photographs reprinted, cropped or enlarged. Thus, a package is needed that provides storage space for both photographic prints and an APS or similar film cartridge and that provides additional protection for the film cartridge.

The exterior of every APS film cartridge includes a unique identifying number. Many cartridges also include an area where the consumer can make his or her own notation regarding the subject matter of the photographs. When the cartridge is simply placed in an envelope with the photographs, the consumer must find the cartridge within the envelope and remove it to determine what the cartridge number is or look through the photographs to determine the subject matter. A photograph holder that effectively displays a portion of the APS film cartridge is needed to enable consumers to quickly identify the cartridge number or subject matter.

Although photo holders incorporating a compartment for APS film cartridges are known, they suffer from a number of defects. Most do not have a locking mechanism and thus, allow the film cartridge to be separated from the photographs. Many photo holders require that an additional strip of material is glued into the photo compartment to form the film cartridge compartment. Other photo holders require an abundance of material in order to incorporate a film cartridge compartment. Thus, a photo holder that secures the film cartridge in the compartment, is made from a single blank and requires a minimum amount of material is needed.

SUMMARY

A photograph holder is provided, which is formed from a unitary blank of material and includes a photograph compartment for containing a plurality of photographs and a film cartridge compartment for containing a generally cylindrical film cartridge. The film cartridge compartment is formed from a panel created by cutting portions of the blank that correspond to at least one side edge of the photo holder and pushing the cut portions inward toward the interior of the holder in order to prepare the film cartridge compartment to contain the film. In a more particular embodiment, the film cartridge is visible from the exterior of the holder.

In another more particular embodiment, the film cartridge compartment includes a platform for elevating the film cartridge and preventing it from falling to the bottom of the holder. In another embodiment, the film cartridge compartment further includes a locking mechanism formed from a panel created by cutting portions of the blank that correspond to at least one side edge and pushing the cut portions inward toward the interior of the holder.

In yet another embodiment, a photograph holder is provided that includes a front panel, a back panel, a pair of side panels, a bottom panel, a top panel and a front flap, the top panel and the front flap forming a cover for the photograph holder; a compartment for containing photographs formed from the front panel, the back panel, the pair of side panels and the bottom panel; at least one compartment for containing a film cartridge comprising a retaining member, a locking mechanism and a platform and formed by cutting a portion of one side panel and at least one of the front panel and the back panel and pushing the cut portions inward toward the interior of the holder in order to prepare the film cartridge compartment to contain the film. The at least one compartment for containing a film cartridge is visible from the exterior of the photograph holder.

In a further embodiment, a photograph holder is provided that includes a front panel, a back panel, a pair of side panels, a top panel and a front flap, the top panel and the front flap forming a cover for the photograph holder; a compartment for containing photographs formed from the front panel, the back panel and the pair of side panels; at least one compartment for containing a film cartridge comprising a retaining member and a platform and formed by cutting a portion of one side panel and at least one of the front panel and the back panel and pushing the cut portions inward toward the interior of the holder in order to prepare the film cartridge compartment to contain the film. The at least one compartment for containing a film cartridge is visible from the exterior of the photograph holder.

In a more particular embodiment, the holder further includes a box configured to hold photographs and fit beneath the photograph compartment and the film cartridge compartment.

In another embodiment, a blank of material for forming a photograph holder is provided including a front panel having a top edge, a bottom edge, a first side edge and a second side edge; a bottom panel connected to the bottom edge of the front panel, the bottom panel having a front edge, a back edge, a first side edge and a second side edge; a back panel connected to the back edge of the bottom panel, the back panel having a top edge, a bottom edge, a first side edge and a second side edge; a top panel connected to the top edge of the back panel, the top panel having a front edge, a back edge, a first side edge and a second side edge; a front flap connected to the front edge of the top panel, the front flap having a top edge, a bottom edge, a first side edge and a second side edge; a pair of side panels attached to the side edges of the back panel and the front panel; at least one film cartridge compartment disposed between at least one side panel and the side edge of at least one of the front panel and the back panel.

In still another embodiment, a blank of material for forming a photograph holder is provided that includes a front panel having a top edge, a bottom edge, a first side edge and a second side edge; a first side panel connected to the first side edge of the front panel, the first side panel having a top edge, a bottom edge, a first side edge and a second side edge; a top panel connected to the top edge of the front panel, the top panel having a front edge, a back edge, a first side edge and a second side edge; a front flap connected to the front edge of the top panel, the front flap having a top edge, a bottom edge, a first side edge and a second side edge; a second side panel having a top edge, a bottom edge, a first side edge and a second side edge, the second side panel connected to the second edge of the front panel at the first side edge of the second side panel; a back panel having a top edge, a bottom edge, a first side edge and a second side edge, the back panel connected to the second edge of the second side panel at the first side edge of the back panel; a third side panel connected to the second side edge of the back panel, the third side panel having a top edge, a bottom edge, a first side edge and a second side edge; at least one film cartridge compartment disposed between at least one side panel and the side edge of at least one of the front panel and the back panel.

BRIEF DESCRIPTION

DETAILED DESCRIPTION

The photo holder of the invention includes many advantages over known photo holders. It is formed from a single blank, thus reducing material and manufacturing costs. It can be assembled very simply, further reducing manufacturing costs. The photo holder provides multiple benefits for consumers. It can be constructed of a sturdy material, such as paperboard, allowing the consumer to use the photo holder for long-term storage of photographs and film. Various features of the invention reduce the likelihood that the film cartridge will be separated from the photographs. Consumers are able to view at least a portion of the unique APS identifying number, or any other notation the consumers makes on the exterior of the film cartridge, from the exterior of the photo holder. Therefore, opening the photo holder is unnecessary to identify the photographs and film within.

Figure 1B:
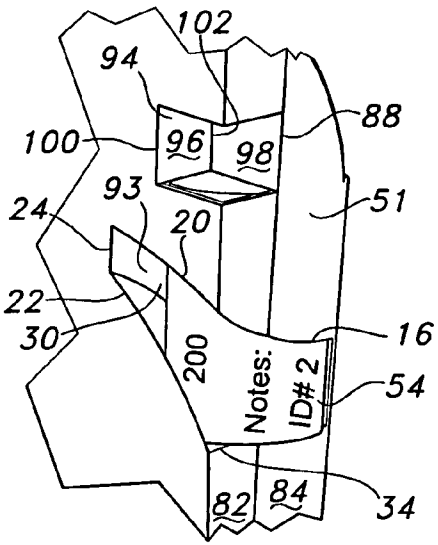
FIG. 1B is a perspective view the film cartridge compartment of FIG. 1 that contains a film cartridge.
Figure 1:
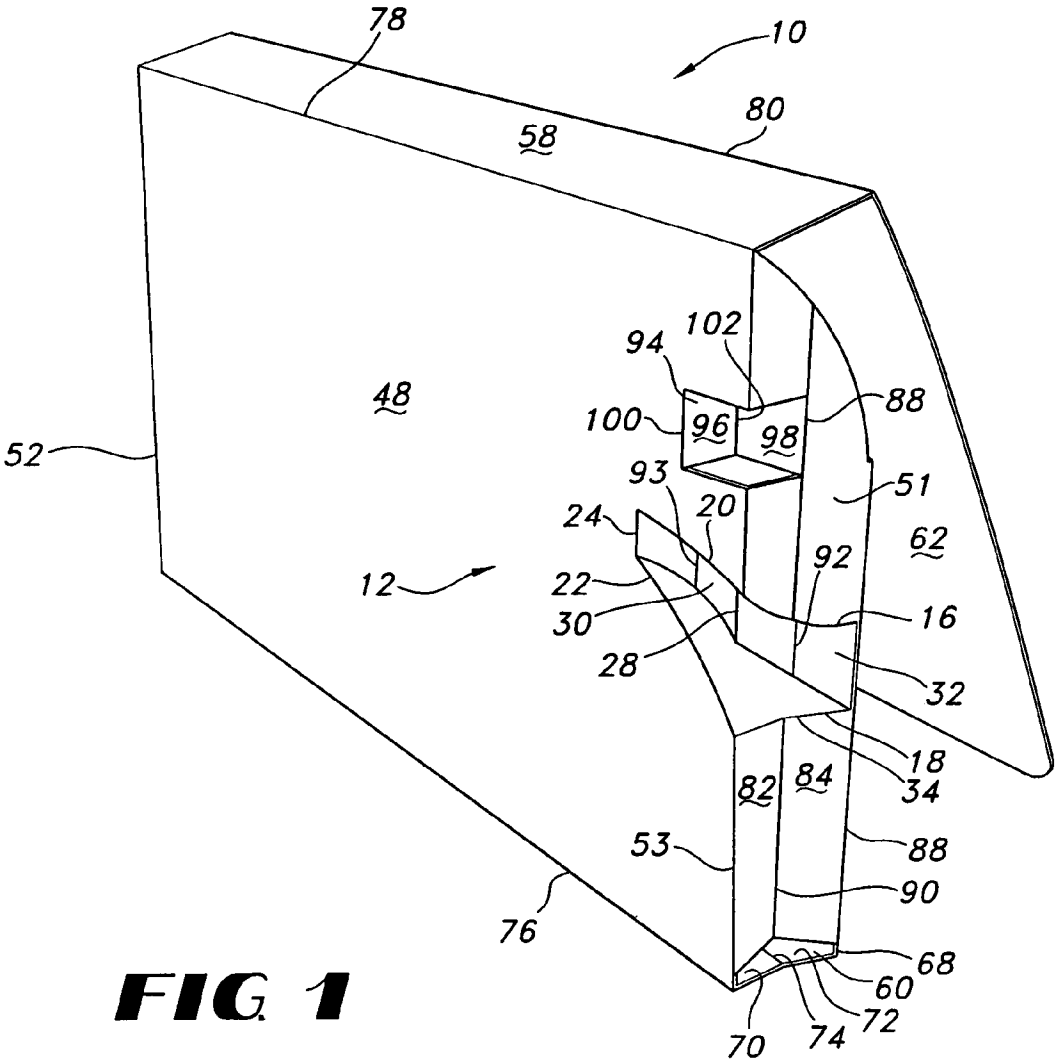
FIG. 1 is a perspective view of a photograph holder according to one embodiment of the invention.

The photo holder 10 of FIG. 1 includes a photograph compartment 11 and a film cartridge compartment 12. The photograph compartment 11 can be configured to hold any size photographs. The film cartridge compartment 12 can be included on any size photo holder 10 and does not require adjustment based on the size of the photo holder 10 or the photograph compartment 11.

The photo holder 10 of FIG. 1 is shaped somewhat like an envelope. The photo holder 10 includes a front panel 56, a back panel 48, a top panel 58, a bottom panel 60 and a front flap 62. The photo holder 10 also includes side panels 50, 51, that may be expandable. The front panel 56 optionally includes an aperture 64 for viewing the photographs (shown in FIG. 6). Most photo-processors include an index print (not shown) that may be placed in a photo holder 10 such that it can be viewed through the aperture 64, thereby giving the consumer a quick look at the photographs within. The aperture 64 may be covered with a clear film 66 to prevent the photographs from being damaged. The front panel 56 is attached to the bottom panel 60 by a fold line 68. The bottom panel 60 may be a single panel or can be divided into multiple panels. For example, in the embodiment shown in FIG. 1, the bottom panel 60 is divided into two panels 70, 72 by a fold line 74. When the bottom panel 60 and the side panels 50, 51 are divided into additional panels, the photo holder 10 can be flattened, minimizing shipping and storage costs. Furthermore, subdividing the panels 50, 51 and bottom panel 60 makes the photo holder 10 expandable. Thus, the photo holder 10 is able to accommodate different quantities of photographs.

The bottom panel 60 is attached to the back panel 48 by a fold line 76. The back panel 48 is attached to the top panel 58 by a fold line 78. The top panel 58 is also attached to the front flap 62 by a fold line 80. Although the front flap 62 is shown extending substantially across the front panel 56, the front flap 62 may be of any size. For example, when the front panel 56 includes a film covered aperture 64, the front flap 62 may end just before the aperture 64 begins so that the photographs are visible from the exterior of the photo holder 10. The front flap 62 may also include a locking mechanism (not shown), such as a tab that fits into a corresponding slot on the front panel 56, snap, hook and loop fasteners, or any other method for locking the front flap 62 to the front panel 56.

The front panel 56 and back panel 48 are attached to sides panels 50, 51 by fold lines 52, 53. The side panels 50, 51 may be further divided into first and second panels 82, 84 and 126, 128 divided by fold lines 90, 92. When both the side panels 50, 51 and the bottom panel 60 are further divided into first and second panels 82, 84, 126, 128, 70, 72, respectively, the empty photo holder 10 is able to be collapsed completely flat, requiring minimal storage space and provided for easy shipping to photo-processors. The photo holder 10 is also able to easily expand or contract to hold varying quantities of photographs.

Various embodiments of the film cartridge compartment 12, such as that shown in FIG. 1, include a retaining panel 14, a platform 34 and a locking mechanism 94. The locking mechanism 94 is formed from two panels 96, 98 cut from the side panel 50 and back panel 48. The panels 96, 98 remain attached to the front panel 56 and back panel 48 by fold lines 100, 88. The panels 96, 98 are also attached to each other by a fold line 102. When pressure is applied from the exterior of the photo holder 10 toward the interior of the photo holder 10, the locking mechanism 94 is depressed inward over the top of a film cartridge 54.

The fold lines 92, 93 allow the retaining panel 14 to hold the film cartridge 54 snugly against the interior of the film cartridge compartment 12. When the retaining panel 14 is pushed inward to provide access for the film cartridge 54, the additional fold lines 92, 93 allow the retaining panel 14 to conform to the substantially round or oval shape of the film cartridge 54. Any number of vertical fold lines may be incorporated into the retaining panel 14. For example, when the photo holder 10 is constructed of a more pliable material, less fold lines on the retaining panel 14 are necessary to conform to the shape of the film cartridge 54, but when using a stiffer material, more fold lines may be necessary.

Figure 2:
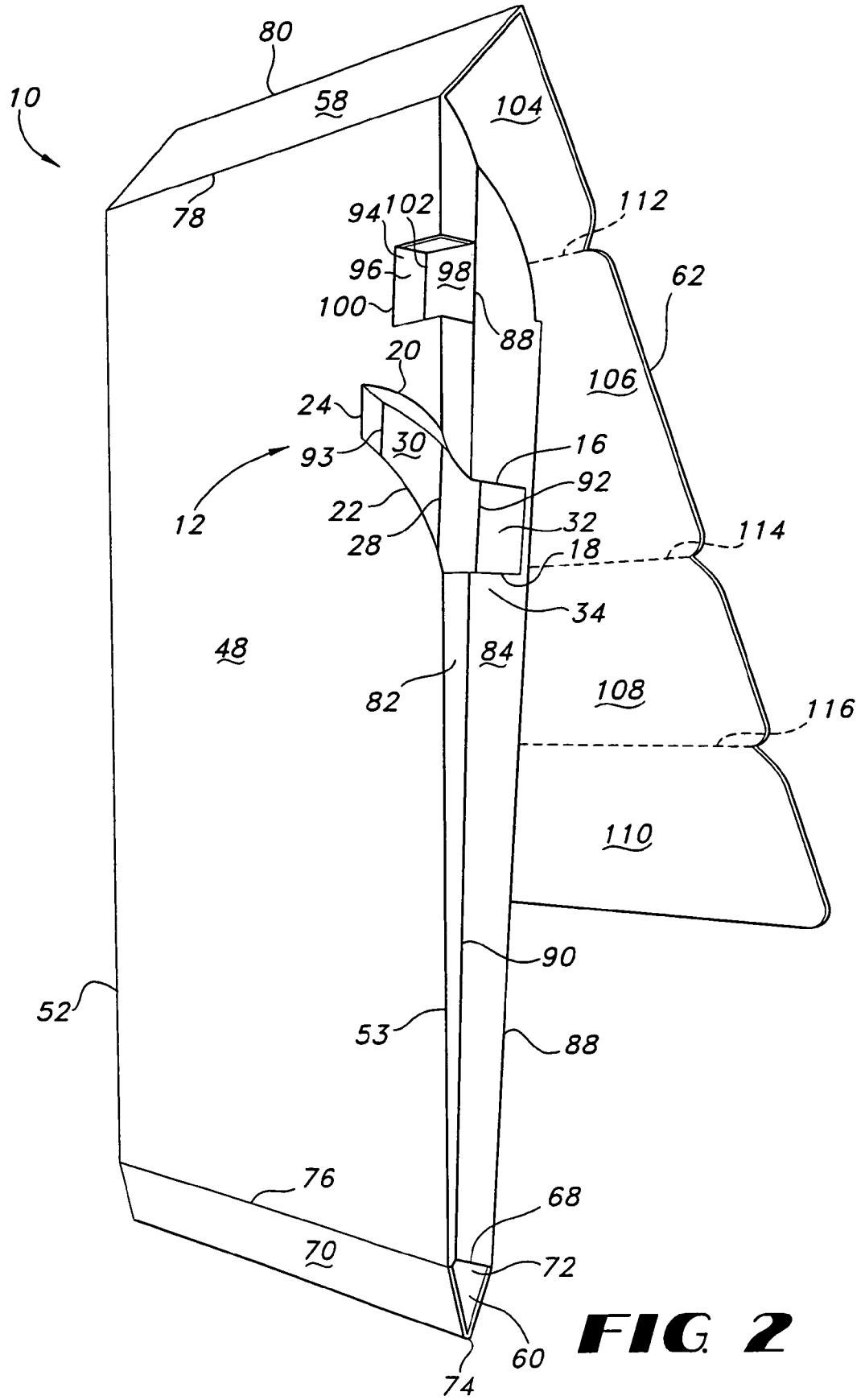
FIG. 2 is a perspective view of a photograph holder according to another embodiment of the invention.

In certain embodiments of the invention, such as that shown in FIG. 2, the front flap 62 is divided into panels 104, 106, 108, 110 by fold lines 112, 114, 116. Any number of fold lines may be used to divide the front flap 62 into the desired number of panels. The panels 104, 106, 108, 110 can be torn away from the rest of the photo holder 10 at the fold lines 112, 114, 116. The fold lines 112, 114, 116 may be perforated such that the panels 106, 108, 110 can be easily removed from the rest of the photo holder 10. The panels 104, 106, 108, 110 may be used to incorporate advertising, coupons, reorder forms, customer receipts, etc. into the photo holder 10. For example, the bottom-most panel 110 may be used to provide the customer with a receipt when they leave their film for processing. The next panel 108 can provide the customer with a coupon for APS film. The next panel 106 can incorporate a reprint form.

The film cartridge component 12 may be on the left or right side of the photo holder. Although the film cartridge compartment 12 has been described as being formed from the back panel 48 and the side panel 51, it may be formed from back panel 48 and side panel 50 or front panel 56 and side panel 50, as is shown in FIG. 3, or front panel 56 and side panel 51.

Figure 3:
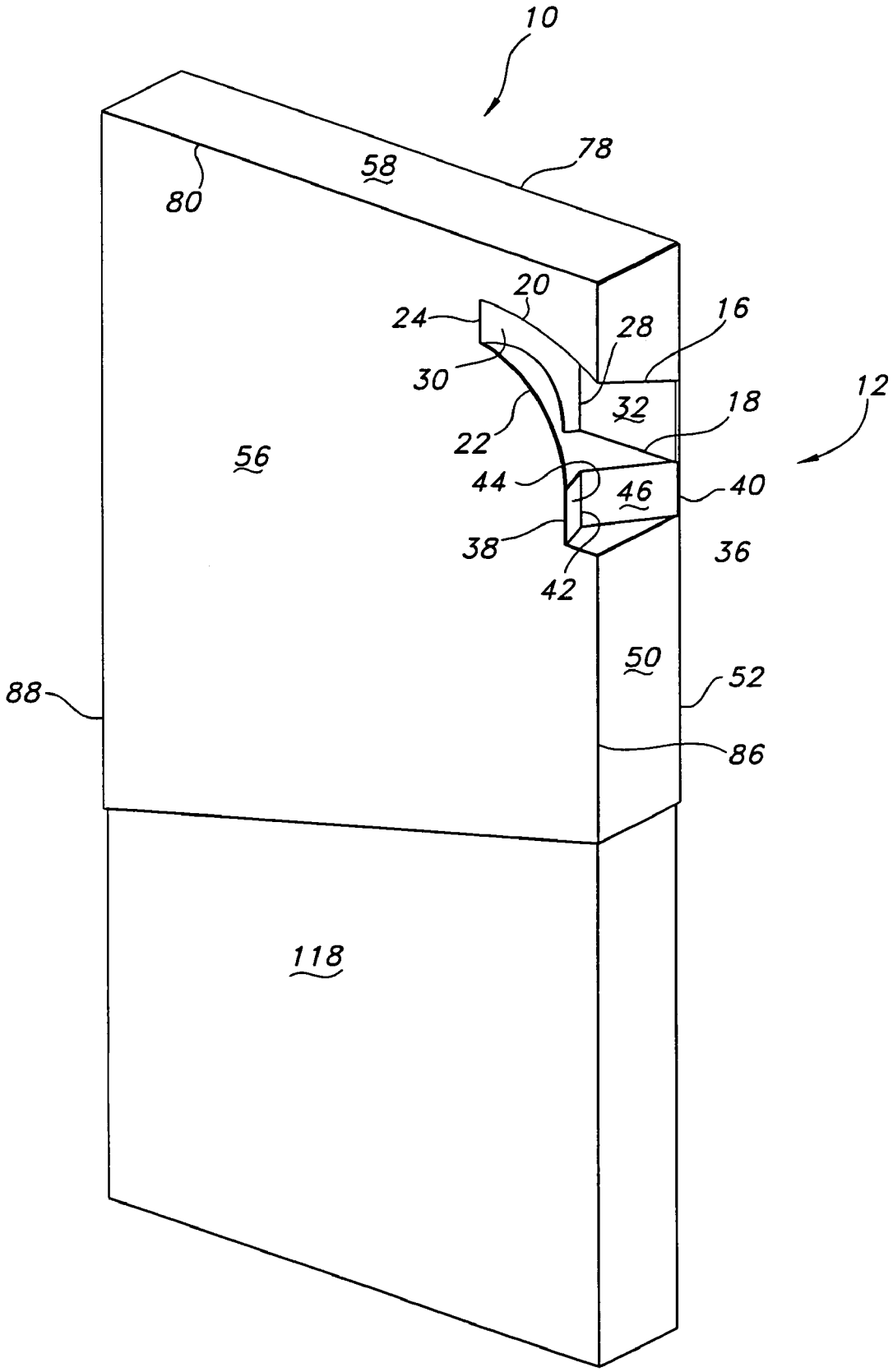
FIG. 3 is a perspective view of a photograph holder according to yet another embodiment of the invention.

In certain embodiments of the invention, such as that shown in FIG. 3, the photo holder 10 fits atop a box 118. The box 118 can be of any size and shape such that it can hold the desired size photographs. Unlike the embodiments shown in FIGS. 1 and 2, the photo holder 10 does not include a bottom panel 60, so that it may fit atop a box 118. Although the front panel 56 and back panel 48 are shown as substantially trapezoidal, it is not necessary that they be trapezoidal and may be square, rectangular or any shape conforming to the box 118 on which the photo holder 10 fits.

Because the embodiment shown in FIG. 3 does not include expandable sides, it may be necessary to form a platform 34 through the use of cut lines 18, 36 and fold lines 38, 40, 42. Thus, a first line 18 can be cut across the side panel 50 and a portion of the back panel 48. A substantially parallel second line 36 can be cut across the side panel 50 and a portion of the back panel 48. The platform 34 can be attached to the front panel 56 and the back panel 48 by fold lines 24, 40. A central fold line 42 separates the platform 34 into two sections 44, 46 that can be depressed to provide a surface on which to place the film cartridge 54. A separate locking mechanism is unnecessary on this embodiment due to the locking mechanism formed by the top panel 58 and the front flap 62.

In another embodiment (not shown), the photo holder 10 shown in FIG. 3 includes a bottom panel, attached to the front panel 56, back panel 48 and side panels 50, 51 by fold lines. In use, the developed prints are placed in the photo holder 10 through the opening formed by the top edges of the front, back and side panels. Next, the film cartridge 54 is placed in the film cartridge compartment 12. The front flap 62 is inserted behind the front panel 56 to secure the prints and film cartridge 54 inside the photo holder 10.

Figure 4:
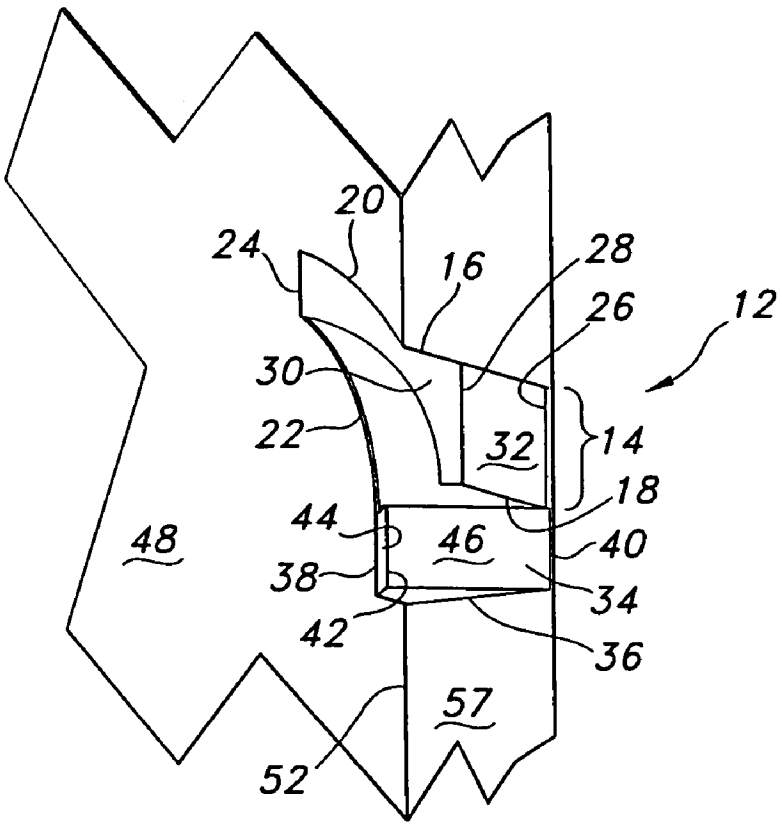
FIG. 4 is a perspective view of a film cartridge compartment of a photo holder according to an embodiment of the invention.

FIG. 4 shows a film cartridge compartment 12 suitable for use with a photo holder 10 and formed in accordance with embodiments of the present invention. The film cartridge compartment 12 is constructed from a retaining member 14 on the photo holder 10. The retaining member 14 can be formed by cutting a first transverse cut line 16 across the side of the photo holder 10. A second transverse cut line 18, substantially parallel to the first cut line 16, spans the side of the photo holder 10. A third transverse cut line 20 can be on the back of the photo holder 10. A fourth cut line 22, substantially diagonal to the third cut line 20, can be across the back of the photo holder 10. First and second vertical fold lines 24, 26 attach the film cartridge compartment 12 to the photo holder 10. A third vertical fold line 28 divides the retaining member 14 into two panels 30, 32. Variations in length of the cut and fold lines and in the angle of the lines in relation to each other are within the scope of the invention.

The film cartridge compartment 12 also includes a platform 34 to prevent the film cartridge 54 from falling to the bottom of the photo holder 10. In one embodiment, shown in FIG. 4, the platform 34 can be formed from a break-in panel which is formed by cut lines 18, 36, and fold lines 38, 40, 42. The break-in panel includes two panels 44, 46 attached to each other and the photo holder 10. A first panel 44 is formed from the back panel 48 of the photo holder 10. A second panel 46 is formed from the side panel 50 of the photo holder 10. The panels 44, 46 are connected by a vertical fold line 42. For economy and ease of manufacturing, the vertical fold lines 28, 42 separating the first and second panels 30, 32 of the retaining member 14 and the first and second panels 44, 46 of the platform 34 may be along the same vertical axis as the fold line 52 separating the back panel 48 and side panel 50 of the photo holder 10.

In another embodiment of the film cartridge compartment 12, shown in FIG. 1B, the platform 34 is formed from an expandable side panel 51. In an embodiment of the photo holder 10 incorporating expandable side 51, the panels 82, 84 forming the expandable side 51 may serve as the platform 34, thus rendering additional cutting and scoring unnecessary. The fold line 90 separating the panels 82, 84 is pressed inward toward the center of the photo holder 10 and providing a surface on which to place the film cartridge 54.

Figure 5:
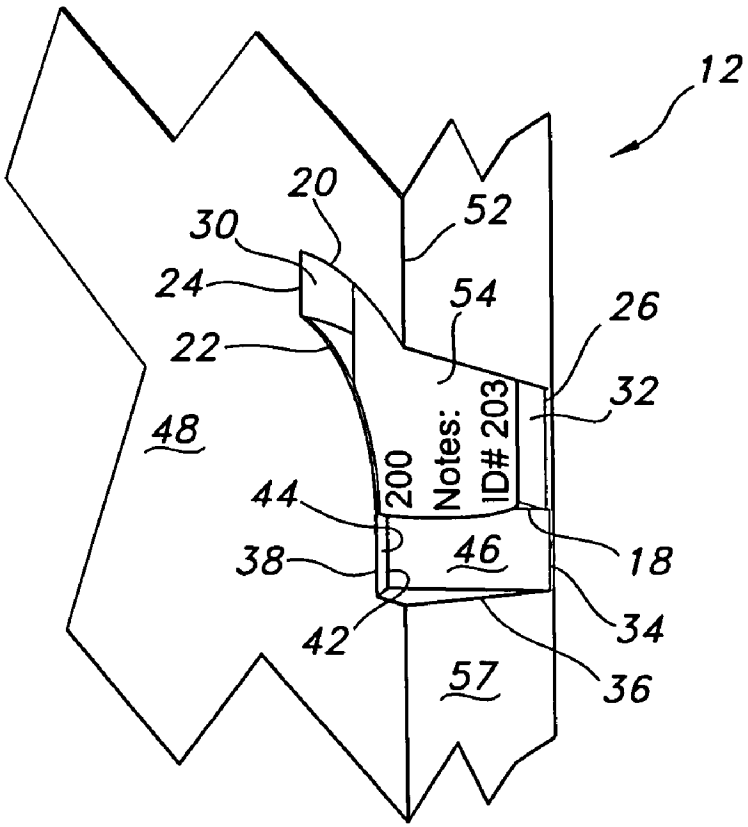
FIG. 5 is a perspective view of the film cartridge compartment of FIG. 4 that contains a film cartridge.

As shown in FIGS. 1B and 5, the film cartridge compartment 12 is adapted to securely hold a film cartridge 54. It is particularly well-suited for holding an APS film cartridge. APS film cartridges include a unique identifying number on the exterior of each cartridge. The film cartridge compartment 12 effectively displays at least a portion of the identifying number from the exterior of the photo holder 10, allowing the consumer to identify the film and photographs within the photo holder 10 without opening it. APS film cartridges often include a section where consumers can make their own notations. The film cartridge compartment 12 can also display a portion of the notations from the exterior of the photo holder 10.

Figure 6:
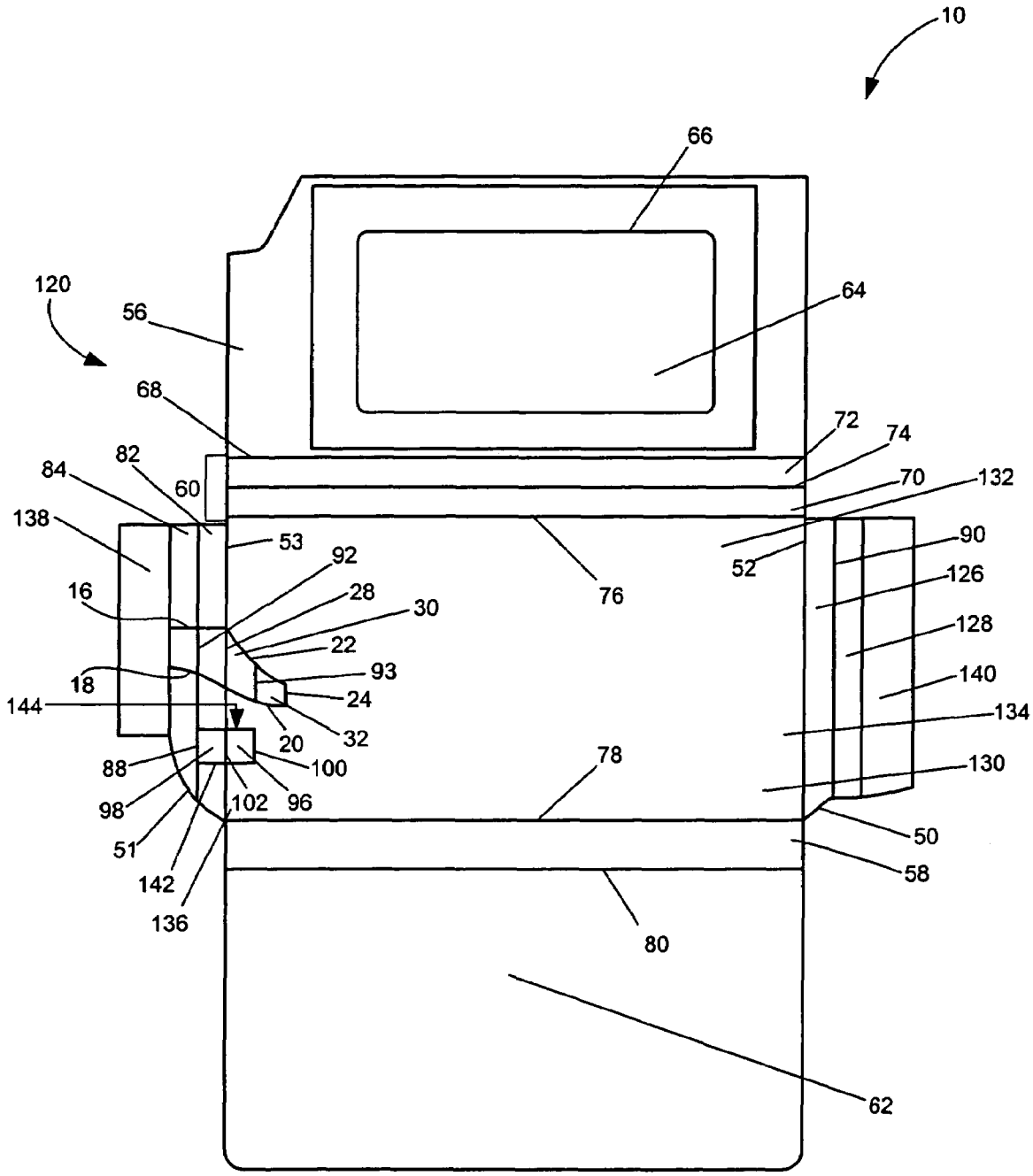
FIG. 6 is a top plan view of a blank of material that may be used to construct the photograph holder of FIG. 1.
Figure 7:
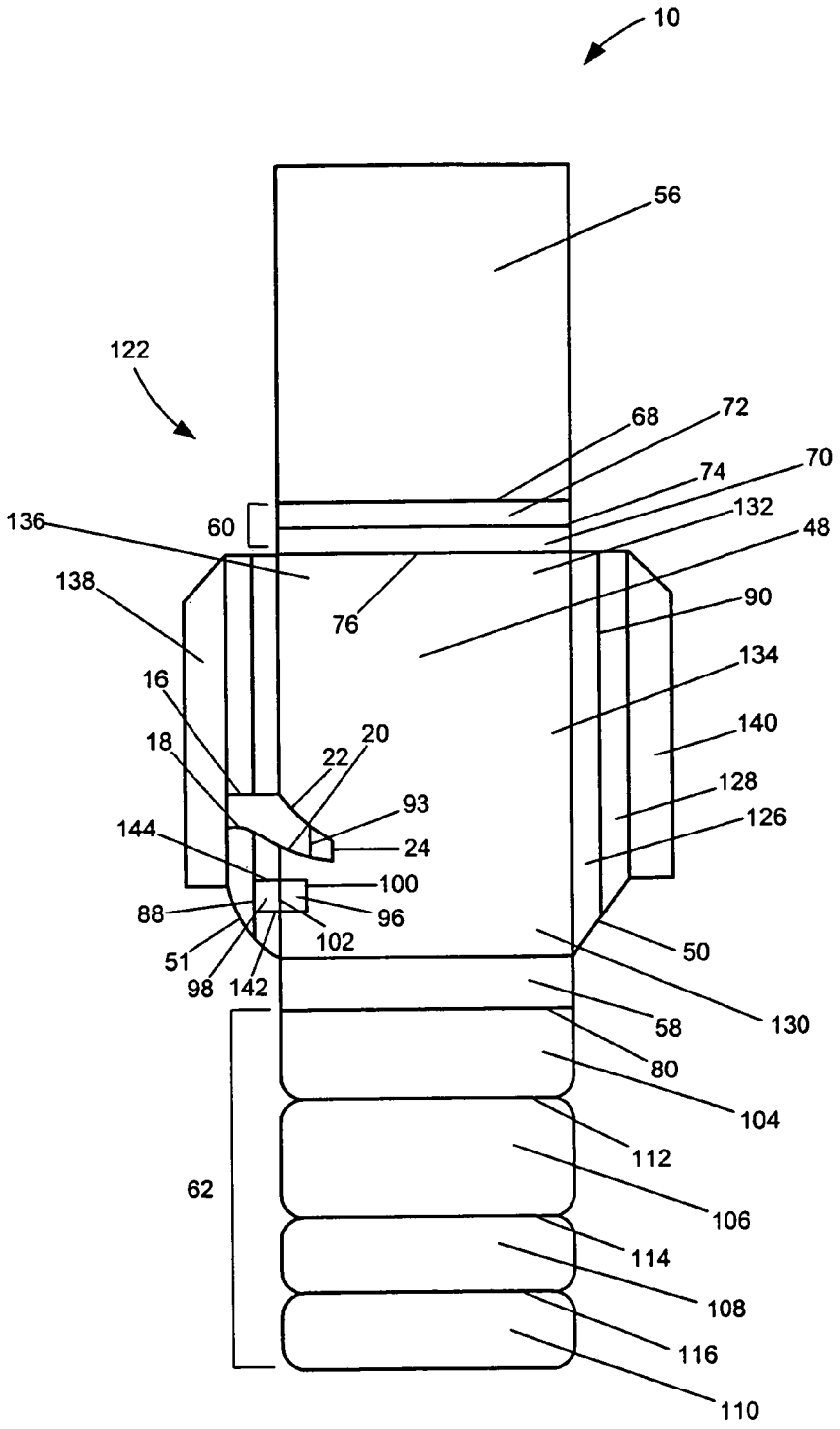
FIG. 7 is a top plan view of a blank of material that may be used to construct the photograph holder of FIG. 2.
Figure 8:
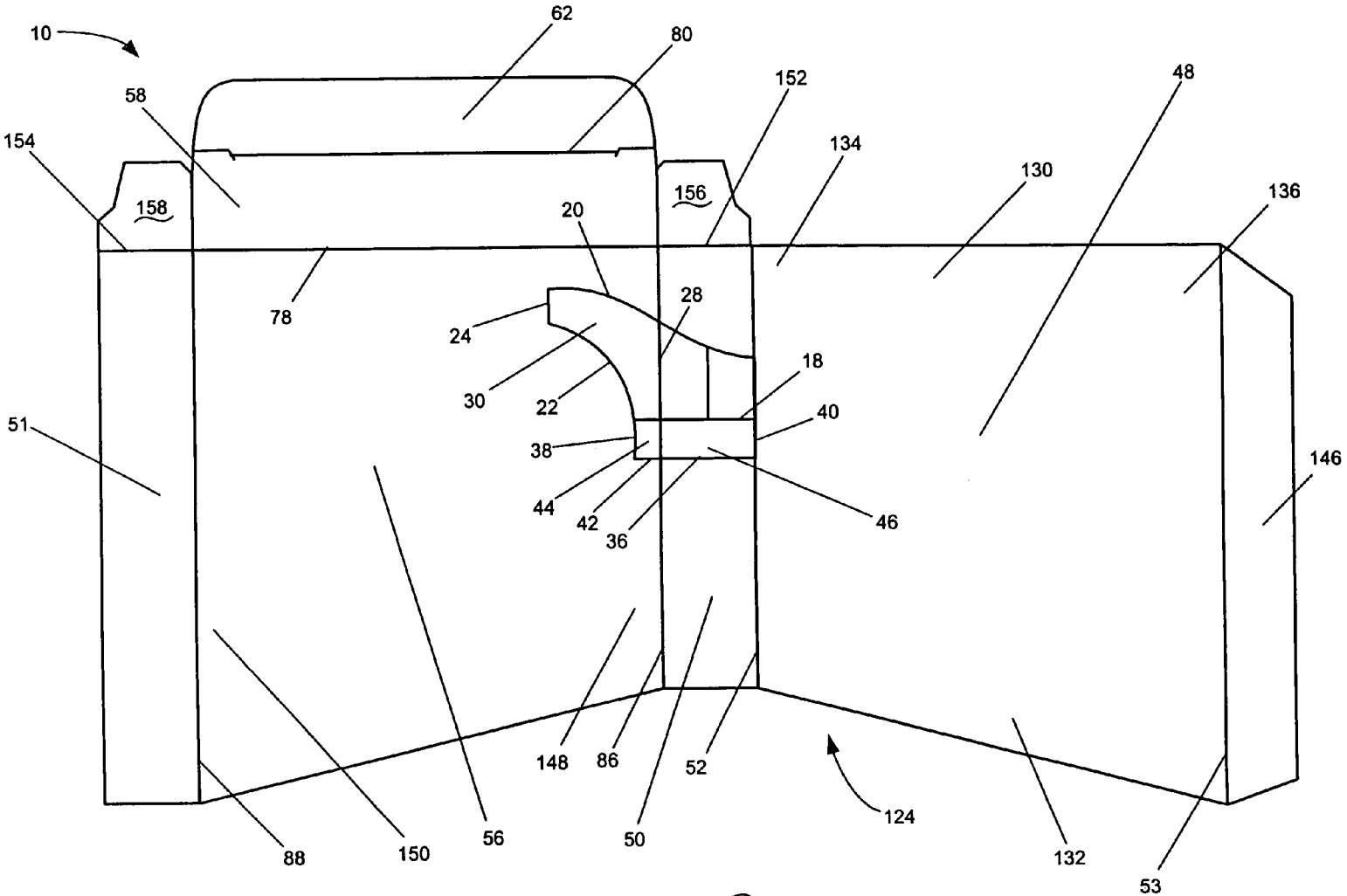
FIG. 8 is a top plan view of a blank of material that may be used to construct the photograph holder of FIG. 3.

The photograph compartment 11 and the film cartridge compartment 12 are formed from a unitary blank of material. FIGS. 6, 7 and 8 illustrate blanks 120, 122, 124 which are suitable for constructing embodiments of the photo holder 10 of the invention. The blanks 120, 122, 124 may be produced from conventional paper products used to make typical photo holders. The blanks 120, 122, 124, however, is preferably constructed from a relatively sturdy material such as paperboard or other suitable material.

FIG. 6 illustrates a blank 120 which is suitable for constructing a photo holder 10 similar to the photo holder 10 of FIG. 1. In this embodiment, the blank 120 includes a back panel 48, a front panel 56, a bottom panel 60, a top panel 58, two side panels 50, 51 and a front flap 62. The back panel 48, front panel 56 and front flap 62 are shown as substantially rectangular, but may be of any shape and size to accommodate the photographs that will be place in the photo holder 10. The back panel 48 has a top edge 130 and bottom edge 132. The back panel 48 also has first and second side edges 134, 136. At the top edge 130, the top panel 58 is attached to the back panel 48 by a fold line 78. At the bottom edge 132, the bottom panel 60 is attached to the back panel 48 by a fold line 76. The first and second side panels 50, 51 are attached to the back panel 48 by adhering attachment panels 138, 140 to the first and second side edges 134, 136 of the back panel 48.

The back panel 48 also includes break-in panels formed by cutting portions of panels and pushing the cut portions inward toward the interior of the photo holder 10. The film cartridge compartment 12 is formed by fold lines and cut lines. On the side edge where the film cartridge compartment 12 is to be located, which may be either side of the photo holder 10, cut lines 142, 144 and fold lines 100, 102 define a first section 96 of the locking mechanism 94. Substantially parallel cut lines 142, 144, perpendicular to the fold line 53 attaching the side panel 51 to the back panel 48, extend a short distance across the back panel 48. The distance may be any length sufficient to help retain the film cartridge 54. A fold line 100 attaches the first section 96 of the locking mechanism 94 to the back panel 48.

A second section 98 of the locking mechanism is formed in the same way and is defined by cut lines 142, 144 and fold lines 88, 102.

The back panel 48 also includes cut lines extending to the side edge and located below that cut lines used to form the locking mechanism 94. These cut lines form a first section of the retaining member 14. A first cut line 20 extends transversely from the side edge of the back panel 48 toward the center of the back panel 48. A second cut line 22 also extends from the side of the back panel 48 toward the center of the back panel 48. The second cut line 22 is substantially diagonal to the first cut line in order to retain the film cartridge 54 in the photo holder 10. A fold line 24 connects the first section of the retaining member 14 to the back panel 48. An optional fold line 93 may divide the first section of the retaining member 14 into two panels 30, 32. This optional fold line 93 allows the retaining member 14 to conform to the shape of the film cartridge 54 and more securely retain the film cartridge 54.

The blank 120 can be easily assembled to form a photo holder 10 similar to that shown in FIG. 1 by adhering or otherwise attaching attachment panels 138, 140 to back panel 48.

FIG. 7 illustrates a blank 122 suitable for constructing a photo holder 10 similar to the photo holder 10 of FIG. 2. In this embodiment, the portion of the blank 124 forming the front flap 62 is constructed of a plurality of panels 104, 106, 108, 110. As shown in the drawing, the panels 104, 106, 108, 110 are attached by fold lines 112, 114, 116. The fold lines 112, 114, 116 may be perforated so that the panels 106, 108, 110 can be easily removed from the photo holder 10. Any number of panels may be incorporated into the blank and that the shape of the panels may vary.

The blank 122 can be easily assembled to form a photo holder 10 similar to that shown in FIG. 1 by adhering or otherwise attaching attachment panels 138, 140 to back panel 48.

FIG. 8 illustrates a blank 124 which is suitable for constructing a photo holder 10 similar to the photo holder 10 of FIG. 3. The blank 124 includes a back panel 48, a front panel 56, a top panel 58, two side panels 50, 51 and a front flap 62. The back panel 48 and front panel 56 are substantially trapezoidal, but may be rectangular, square or any other shape that will conform to a box that holds photographic prints. The back panel 48 has a top edge 130, a bottom edge 132 and first and second side edges 134, 136. At the top edge, the top panel 58 is attached to the back panel 48 by a fold line. The first and second side panels 50, 51 are attached to the first and second side edges 148, 150 of the front panel 56 by fold lines 86, 88. The side panels 50, 51 include transverse cut lines 152, 154 forming top flaps 156, 158. First side panel 50 is attached to the side edge 134 of the back panel 48. The back panel 48 may alternatively be attached to side panel 51. The back panel 48 further includes a side flap 146 attached by a fold line 53. To form a photo holder 10 similar to that shown in FIG. 3, the side flap 146 is attached to the side panel 51. Any method may be used to attach the panels, but gluing the panels has been found to be particularly effective. At its front edge, the top panel 58 is attached to the front flap 62.

The back panel 48 and side panel 50 also includes break-in panels defined by fold lines and cut lines, forming a portion of the film cartridge compartment 12. On the side panel where the film cartridge 12 is located, which can be either side, cut lines and fold lines form a retaining member 14. A first cut line 20 extends transversely from the side edge of the front panel 56 toward the center of the front panel 56. A second cut line 22 also extends from the side of the front panel 56 toward the center of the front panel 56. The second cut line 22 is substantially diagonal to the first cut line 20 in order to retain the film cartridge 54 in the photo holder 10. A fold line 24 connects the retaining member 14 to the front panel 56. The retaining member 14 is divided into two sections by fold line 28. The fold line 28 allows the retaining member 14 to more readily conform to the shape of the film cartridge 54.

The front panel 56 and side panel 50 also include cut lines 18, 36 and fold lines 38, 40, 42 to form a platform 34 to prevent the film cartridge from falling to the bottom of the photo holder 10. Cut lines 18, 36 and fold lines 38, 40 form the platform 34. The platform 34 includes two panels 44, 46.

A first panel 44 is formed from the back panel 48 and is defined by cut lines 18, 36 and fold lines. A second panel 46 is formed from the side panel 50 and defined by cut lines 18, 36 and fold lines.

The foregoing description is provided for describing various embodiments and structures relating to the invention. Various modifications, additions and deletions may be made to these embodiments and/or structures without departing from the scope and spirit of the invention.

What is claimed is:

1. A photograph holder formed from a unitary blank of material and comprising a photograph compartment for containing a plurality of photographs and a film cartridge compartment for containing a generally cylindrical film cartridge, wherein the photograph compartment is at least partially enclosed on three sides and wherein the film cartridge compartment is formed from a panel created by cutting portions of the blank that correspond to at least one side edge of the holder and pushing the cut portions inward toward an interior of the holder in order to prepare the film cartridge compartment to contain the film.

2. The photograph holder of claim 1 wherein the film cartridge compartment comprises a platform for elevating the film cartridge.

3. The photograph holder of claim 2 wherein the platform is formed from a panel created by cutting portions of the blank that correspond to at least one side edge of the holder and pushing the cut portions inward toward the interior of the holder.

4. The photograph holder of claim 1 wherein the film cartridge compartment further comprises a locking member formed from a panel created by cutting portions of the blank that correspond to at least one side edge of the holder and pushing the cut portions inward toward the interior of the holder.

5. The photograph holder of claim 1 wherein at least a portion of the film cartridge is visible from the exterior of the photograph holder.

6. A photograph holder comprising:

(a) a front panel, a back panel, a pair of side panels, a top panel and a front flap, the top panel and the front flap forming a cover for the photograph holder;

(b) a compartment for containing photographs formed from the front panel, the back panel, and the pair of side panels;

(c) at least one compartment for containing a film cartridge comprising a retaining member and a platform and formed by cutting a portion of one side panel and at least one of the front panel and the back panel and pushing the cut portions inward toward an interior of the holder in order to prepare the film cartridge compartment to contain the film;

wherein at least a portion of a film cartridge in the at least one compartment for containing a film cartridge is visible from the exterior of the photograph holder.

7. The photograph holder of claim 6 further comprising a bottom panel connected to the front panel and back panel.

8. The photograph holder of claim 7 wherein the side panels and the bottom panel are expandable.

9. The photograph holder of claim 6 further comprising a locking, member.

10. The photograph holder of claim 9 wherein the locking member comprises a break-in panel formed by cutting a portion of one side panel and at least one of the front panel and the back panel and pushing the cut portions inward toward the interior of the holder.

11. The photograph holder of claim 6 wherein the front flap extends substantially across the front panel and comprises at least two panels separated by perforated score lines.

12. The photograph holder of claim 6 wherein the front panel further comprises an aperture covered with a clear film.

13. The photograph holder of claim 6, wherein the platform is formed from a panel created below the film cartridge compartment by cutting a portion of the side panel and at least one of the front panel and the back panel and pushing the cut portions inward toward the interior of the holder.

14. The photograph holder of claim 13 further comprising a box configured to hold photographs and to fit beneath the photograph compartment and the film cartridge compartment.

15. A photograph holder comprising:

(a) a front panel, a back panel, a pair of expandable side panels, a top panel, an expandable bottom and a front flap, the top panel and the front flap forming a cover for the photograph holder;

(b) a compartment for containing photographs formed from the front panel, the back panel, the bottom panel and the pair of side panels;

(c) at least one compartment for containing a film cartridge formed by cutting a portion of one side panel and at least one of the front panel and the back panel and pushing the cut portions inward toward the interior of the holder in order to prepare the film cartridge compartment to contain the film and comprising a retaining member formed by cutting a portion of one side panel and at least one of the front panel and the back panel and pushing the cut portions inward toward the interior of the holder, a locking member comprising a break-in panel formed by cutting a portion of one side panel and at least one of the front panel and the back panel and pushing the cut portions inward toward an interior of the holder, and a platform formed from the expandable side panels;

wherein at least a portion of a film cartridge in the at least one compartment for containing a film cartridge is visible from the exterior of the photograph holder.

16. A blank of material for forming a photograph holder comprising:

(a) a front panel having a top edge, a bottom edge, a first side edge and a second side edge;

(b) a bottom panel connected to the bottom edge of the front panel, the bottom panel having a front edge, a back edge, a first side edge and a second side edge;

(c) a back panel connected to the back edge of the bottom panel, the back panel having a top edge, a bottom edge, a first side edge and a second side edge;

(d) a top panel connected to the top edge of the back panel, the top panel having a front edge, a back edge, a first side edge and a second side edge;

(e) a front flap connected to the front edge of the top panel, the front flap having a top edge, a bottom edge, a first side edge and a second side edge;

(f) a pair of side panels attached to the side edges of the back panel and the front panel;

(g) a plurality of cuts in the at least one side panel and in the side edge of at least one of the front panel and the back panel form a film cartridge compartment which, when the blank is formed into a photograph holder, may be created by pushing the cut portion inward toward the interior of the photograph holder without the need for attaching or gluing additional material to the blank or photograph holder.

17. The blank of claim 16 wherein the first and second side panels are divided into first and second panels by a fold line.

18. The blank of claim 16 wherein the bottom panel is divided into first and second panels by a fold line.

19. The blank of claim 16 wherein a plurality of cuts in the at least one side panel and in the side edge of at least one of the front panel and the back panel form a locking member which, when the blank is formed into a photograph holder, may be created by pushing the cut portion inward toward the interior of the photograph holder without the need for attaching or gluing additional material to the blank or photograph holder.

20. The blank of claim 16 wherein the front flap comprises at least two panels by perforated score lines.

21. The blank of claim 16 wherein the front panel further comprises an aperature covered by a clear film.

22. A photograph holder comprising:

(a) means formed from a unitary blank of material for containing photographs and at least one film cartridge in a single container;

(b) means formed from the unitary blank of material for securing the at least one film cartridge on the container; and (c) means formed from the unitary blank of material for displaying at least a portion of the at least one film cartridge from the exterior of the container when the container is closed, wherein the displaying means do not require attachment of additional material.

23. The photograph holder of claim 22 further comprising means for displaying at least a portion of the photographs from the exterior of the container when the container.

* * * * *